US010102801B2

(12) United States Patent
Jin

(10) Patent No.: US 10,102,801 B2
(45) Date of Patent: Oct. 16, 2018

(54) ORGANIC LIGHT-EMITTING DIODE DISPLAY PANEL, ORGANIC LIGHT-EMITTING DIODE DISPLAY DEVICE, AND METHOD OF DRIVING THE SAME

(71) Applicant: LG DISPLAY CO., LTD., Seoul (KR)

(72) Inventor: Hojeong Jin, Anyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 174 days.

(21) Appl. No.: 14/955,779

(22) Filed: Dec. 1, 2015

(65) Prior Publication Data

US 2016/0189629 A1 Jun. 30, 2016

(30) Foreign Application Priority Data

Dec. 24, 2014 (KR) ..... 10-2014-0188248

(51) Int. Cl.
*G09G 3/30* (2006.01)
*G09G 3/3233* (2016.01)
*G09G 3/10* (2006.01)

(52) U.S. Cl.
CPC ... *G09G 3/3233* (2013.01); *G09G 2300/0861* (2013.01); *G09G 2310/0251* (2013.01); *G09G 2310/0262* (2013.01); *G09G 2320/043* (2013.01)

(58) Field of Classification Search
CPC ..... G09G 3/3225; G09G 3/3233
USPC ..... 345/76; 315/169.3
See application file for complete search history.

(56) References Cited

U.S. PATENT DOCUMENTS

2008/0231562 A1 9/2008 Kwon
2009/0058772 A1* 3/2009 Lee ..... G09G 3/3233 345/82
2010/0134468 A1* 6/2010 Ogura ..... G09G 3/3291 345/211
2010/0188320 A1* 7/2010 Min ..... G09G 3/3291 345/80
2010/0328365 A1* 12/2010 Ikeda ..... G09G 3/3233 345/690
2011/0018858 A1* 1/2011 Ryu ..... G09G 3/3233 345/213
2011/0130981 A1* 6/2011 Chaji ..... G09G 3/006 702/58
2011/0227505 A1* 9/2011 Park ..... G09G 3/3233 315/297
2013/0027380 A1* 1/2013 Wang ..... G09G 3/3233 345/212
2013/0050292 A1* 2/2013 Mizukoshi ..... G09G 3/3291 345/690

(Continued)

FOREIGN PATENT DOCUMENTS

CN 102074189 A 5/2011
CN 102968954 A 3/2013

(Continued)

*Primary Examiner* — Adam J Snyder
(74) *Attorney, Agent, or Firm* — Birch, Stewart, Kolasch & Birch, LLP

(57) ABSTRACT

An organic light-emitting diode (OLED) display panel, an OLED display device, and a method of driving the same are discussed, which can improve image quality by enabling compensation for the unique characteristics of a driving transistor without an influence on gradation under any circumstances.

9 Claims, 12 Drawing Sheets

(56) References Cited

U.S. PATENT DOCUMENTS

| | | | | |
|---|---|---|---|---|
| 2013/0127692 | A1* | 5/2013 | Yoon | G09G 3/3258 345/80 |
| 2013/0201173 | A1* | 8/2013 | Chaji | G09G 3/3233 345/212 |
| 2013/0314394 | A1* | 11/2013 | Chaji | G09G 3/00 345/212 |
| 2014/0062993 | A1* | 3/2014 | Chaji | G09G 3/3225 345/212 |
| 2014/0084932 | A1* | 3/2014 | Chaji | G09G 3/3233 324/414 |
| 2014/0168194 | A1 | 6/2014 | Kong et al. | |
| 2014/0285407 | A1* | 9/2014 | Chaji | G09G 3/3233 345/76 |
| 2016/0019839 | A1* | 1/2016 | In | G09G 3/3258 345/212 |
| 2016/0055791 | A1* | 2/2016 | Kishi | G09G 3/3241 345/212 |
| 2016/0071463 | A1* | 3/2016 | Takahashi | G09G 3/3225 345/76 |
| 2017/0025061 | A1* | 1/2017 | Takizawa | G09G 3/3233 |

FOREIGN PATENT DOCUMENTS

| | | | |
|---|---|---|---|
| CN | 103165078 | A | 6/2013 |
| CN | 103871362 | A | 6/2014 |
| KR | 10-2013-0036661 | A | 4/2013 |
| KR | 10-2014-0091096 | A | 7/2014 |

* cited by examiner

ORGANIC LIGHT-EMITTING DIODE DISPLAY PANEL, ORGANIC LIGHT-EMITTING DIODE DISPLAY DEVICE, AND METHOD OF DRIVING THE SAME

CROSS REFERENCE TO RELATED APPLICATION

This application claims priority from and the benefit under 35 U.S.C. § 119(a) of Korean Patent Application Number 10-2014-0188248 filed on Dec. 24, 2014, which is hereby incorporated by reference for all purposes as if fully set forth herein.

BACKGROUND OF THE INVENTION

Field of the Invention

The present invention relates to an organic light-emitting diode (OLED) display panel, an OLED display device, and a method of driving the same.

Description of Related Art

Organic light-emitting diode (OLED) display devices have recently been prominent as next generation display devices. Such OLED display devices have inherent advantages, such as relatively fast response speeds, high contrast ratios, high light-emitting efficiency, high luminance levels, and wide viewing angles, since OLEDs capable of emitting light by themselves are used therein.

Each subpixel disposed on an OLED display panel of such an OLED display device basically includes an OLED and a driving transistor driving the OLED.

Such an OLED display device displays an image by adjusting the brightness of each OLED using a driving current from a driving transistor, determined based on a data voltage output by a data driver.

The driving transistor in each of the subpixels on the OLED display panel has unique characteristics, such as a threshold voltage and mobility. Degradations in the performance of the driving transistor may occur, along with the lapse of driving time, whereby the characteristics thereof may change.

Such degradations may produce variations in the unique characteristics of the driving transistors of the subpixels, causing variations in the luminance of the subpixels, whereby image quality may be degraded.

Therefore, technologies for the compensation of variations in the luminance of the subpixels, i.e., technologies for the compensation of variations in the unique characteristics of the driving transistors, have been proposed.

However, regardless of such compensation technologies, for various reasons, variations in the unique characteristics of driving transistors may not be properly compensated in some cases.

In addition, although such variations in the unique characteristics of driving transistors are compensated by the compensation technologies, image quality may be degraded instead of being improved, which may be problematic.

BRIEF SUMMARY OF THE INVENTION

Various aspects of the present invention provide an organic light-emitting diode (OLED) display panel, an OLED display device, and a method of driving the same, which can improve image quality by more efficiently performing compensation for the unique characteristics of a driving transistor DRT.

Also provided are an OLED display panel, an OLED display device, and a method of driving the same able to improve image quality by enabling compensation for the unique characteristics of a driving transistor without an influence on gradation under any circumstances.

Also provided are an OLED display panel, an OLED display device, and a method of driving the same able to improve image quality by enabling compensation for the unique characteristics of a driving transistor regardless of a threshold voltage shift in the driving transistor.

According to an embodiment of the present disclosure, an OLED display device includes an OLED display panel including a plurality of data lines, a plurality of gate lines, and a matrix of a plurality of subpixels disposed thereon; a data driver driving the plurality of data lines; a gate driver driving the plurality of gate lines; and a timing controller controlling the data driver and the gate driver.

Each of the plurality of subpixels can include an OLED; a driving transistor having a first node electrically connected to a first electrode of the OLED, a second node corresponding to a gate electrode, and a third node electrically connected to a driving voltage line; a first transistor electrically connected between the first node of the driving transistor and a reference voltage line; a second transistor electrically connected between the second node of the driving transistor and a corresponding data line among the plurality of data lines; and a storage capacitor electrically connected between the first node and the second node of the driving transistor.

In this OLED display device, a data voltage available range for a data voltage applied to the second node of the driving transistor is variable.

In addition, in this OLED display device, the reference voltage may vary in a negative direction, such that the data voltage available range expands in response to the reference voltage being reduced.

According to another embodiment of the present disclosure, an OLED display panel includes a plurality of data lines; a plurality of data lines; and a matrix of a plurality of subpixels disposed thereon.

Each of the plurality of subpixels can include an OLED; a driving transistor having a first node electrically connected to a first electrode of the OLED, a second node corresponding to a gate electrode, and a third node electrically connected to a driving voltage line; a first transistor electrically connected between the first node of the driving transistor and a reference voltage line; a second transistor electrically connected between the second node of the driving transistor and a corresponding data line among the plurality of data lines; and a storage capacitor electrically connected between the first node and the second node of the driving transistor.

In this OLED display panel, a data voltage available range for a data voltage applied to the second node of the driving transistor is variable.

According to a further embodiment of the present disclosure, provided is a method of driving an OLED display device, wherein the OLED display device includes a matrix of a plurality of subpixels disposed thereon, each of the subpixels including: an OLED; a driving transistor including a first node electrically connected to the first electrode of the OLED, a second node corresponding to a gate node, and a third node electrically connected to a driving voltage line; a first transistor electrically connected between the first node of the driving transistor and a reference voltage line; a second transistor electrically connected between the second node of the driving transistor and a data line; and a storage capacitor electrically connected between the first node and the second node of the driving transistor.

The driving method can include sensing a threshold voltage shift about the driving transistor in each of the plurality of subpixels; and depending on a result of sensing the threshold voltage shift, varying a data voltage available range of a data voltage applied to the second node of the driving transistor in each of the plurality of subpixels.

According to the present embodiments, the OLED display panel, the OLED display device, and the method of driving the same can improve image quality by more efficiently performing compensation for the unique characteristics of the driving transistor.

In addition, according to the present embodiments, the OLED display panel, the OLED display device, and the method of driving the same can improve image quality by enabling compensation for the unique characteristics of the driving transistor without an influence on gradation under any circumstances.

Furthermore, according to the present embodiments, the OLED display panel, the OLED display device, and the method of driving the same can improve image quality by enabling compensation for the unique characteristics of the driving transistor regardless of a threshold voltage shift in the driving transistor.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
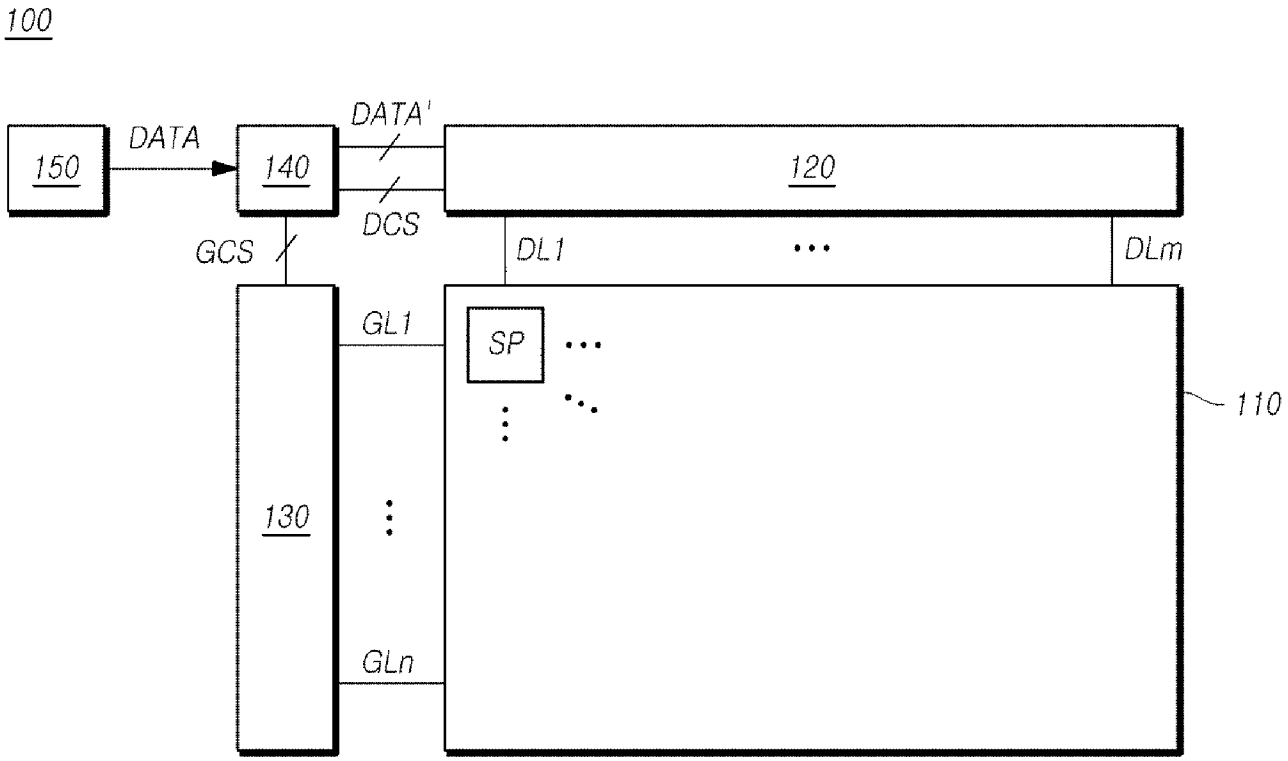
FIG. 1 is a schematic system configuration diagram illustrating an organic light-emitting diode (OLED) display device according to present embodiments of the invention.

Reference will now be made in detail to embodiments of the present invention, examples of which are illustrated in the accompanying drawings. Throughout this document, reference should be made to the drawings, in which the same reference numerals and signs will be used to designate the same or like components. In the following description of the present invention, detailed descriptions of known functions and components incorporated herein will be omitted in the case that the subject matter of the present invention may be rendered unclear thereby.

It will also be understood that, while terms such as "first," "second," "A," "B," "(a)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic system configuration diagram illustrating an organic light-emitting diode (OLED) display device 100 according to present embodiments of the invention.

Referring to FIG. 1, the OLED display device 100 according to the present embodiments includes an OLED display panel 110, a data driver 120, a gate driver 130, and a timing controller 140. All the components of the OLED display device in all embodiments of the present invention are operatively coupled and configured.

On the OLED display panel 110, a plurality of data lines DL1 to DLm (where m is a natural number equal to or greater than 2) are disposed in a first direction, a plurality of gate lines GL1 to GLn (where n is a natural number equal to or greater than 2) are disposed in a second direction intersecting the first direction, and a plurality of subpixels SP are arranged in a matrix.

The data driver 120 drives the plurality of data lines DL1 to DLm by supplying data voltages thereto.

The gate driver 130 sequentially drives the plurality of gate lines GL1 to GLn by sequentially supplying a scanning signal to the plurality of gate lines GL1 to GLn.

The timing controller 140 controls the operation of the data driver 120 and the operation of the gate driver 130 by supplying control signals to the data driver 120 and the gate driver 130.

The timing controller 140 starts scanning following the timing realized by each frame, outputs converted image data Data' by converting image data Data input by a host system 150 into a data signal format readable by the data driver 120, and regulates data processing at a suitable point in time in response to the scanning.

The gate driver 130 sequentially drives the plurality of gate lines GL1 to GLn by sequentially supplying a scanning signal having an on or off voltage to the plurality of gate lines GL1 to GLn under the control of the timing controller 140.

The gate driver 130 is positioned on one side of the OLED display panel 110, as illustrated in FIG. 1. Depending on the driving method, the gate driver 130 may be divided into two sections, positioned on both sides of the OLED display panel 110.

In addition, the gate driver 130 includes a plurality of gate driver ICs. Each of the plurality of gate driver ICs may be connected to the bonding pads of the OLED display panel 110 by tape-automated bonding (TAB) or chip-on-glass (COG) bonding, may be implemented as a gate-in-panel (GIP)-type IC directly disposed on the OLED display panel 110, or in some cases, may be integrated with the OLED display panel 110, forming a portion of the OLED display panel 110.

Each of the above-mentioned gate driver ICs includes a shift resistor, a level shifter, and the like.

When a specific gate line is opened, the data driver 120 drives the data lines DL1 to DLm by converting image data Data' received from the timing controller 140 into analog data voltages Vdata and supplying the analog data voltages Vdata to the data lines DL1 to DLm.

The data driver 120 includes a plurality of source driver ICs (also referred to as data driver ICs). Each of the plurality of source driver ICs may be connected to the bonding pads of the OLED display panel 110 by tape-automated bonding (TAB) or chip-on-glass (COG) bonding, may be directly disposed on the OLED display panel 110, or in some cases, may be integrated with the OLED display panel 110, forming a portion of the OLED display panel 110.

Each of the above-mentioned source driver ICs includes a shift resistor, a latch, a digital-to-analog converter (DAC), an output buffer, and the like. In some cases, each source driver IC may include an analog-to-digital converter (ADC) for subpixel compensation. The ADC senses an analog voltage value, converts the sensed analog voltage value to a digital value, and generates and outputs sensed data.

The plurality of source driver ICs are formed using a chip-on-film (COF) method. In each of the plurality of source driver ICs, one end is bonded to at least one source printed circuit board (SPCB), and the other end is bonded to the bonding pads of the OLED display panel 110.

The above-mentioned host system 150 transmits a variety of timing signals including a vertical synchronization signal Vsync, a horizontal synchronization signal Hsync, an input data enable (DE) signal, and a clock (CLK) signal together with the image data Data of an input image to the timing controller 140.

The timing controller 140 outputs converted image data Data' by converting image data Data input from the host system 160 into a data signal format readable by the data driver 120. In addition, the timing controller 140 receives timing signals, including a vertical synchronization signal Vsync, a horizontal synchronization signal Hsync, an input DE signal, and a clock signal, generates a variety of control signals based on the input timing signals, and outputs the variety of control signals to the data driver 120 and the gate driver 130 in order to control the data driver 120 and the gate driver 130.

For example, the timing controller 140 outputs a variety of gate control signals (GCSs) including a gate start pulse (GSP), a gate shift clock (GSC) signal, and a gate output enable (GOE) signal in order to control the gate driver 130.

The GSP controls the operation start timing of the gate driver ICs of the gate driver 130. The GSC signal is a clock signal commonly input to the gate driver ICs to control the shift timing of a scanning signal (gate pulse). The GOE signal designates the timing information of the gate driver ICs.

The timing controller 140 outputs a variety of data control signals (DCSs) including a source start pulse (SSP), a source sampling clock (SSC) signal, and a source output enable (SOE) signal in order to control the data driver 120.

The SSP controls the data sampling start timing of the source driver ICs of the data driver 120. The SSC signal is a clock signal to control the data sampling timing of each of the source driver ICs. The SOE signal controls the output timing of the data driver 120. In some cases, the DCSs may further include a polarity (POL) control signal in order to control the polarity of the data voltages of the data driver 120. The SSP and SSC signals may be omitted when image data Data' input to the data driver 120 is transmitted, based on the mini-low voltage differential signaling (m-LVDS) interface specification.

Referring to FIG. 1, the OLED display device 100 further includes a power controller (not shown) supplying a variety of voltages or currents to the OLED display panel 110, the data driver 120, the gate driver 130, and the like, or controls the variety of voltages or currents to be supplied. The power controller is also referred to as a power management IC (PMIC).

Figure 2:
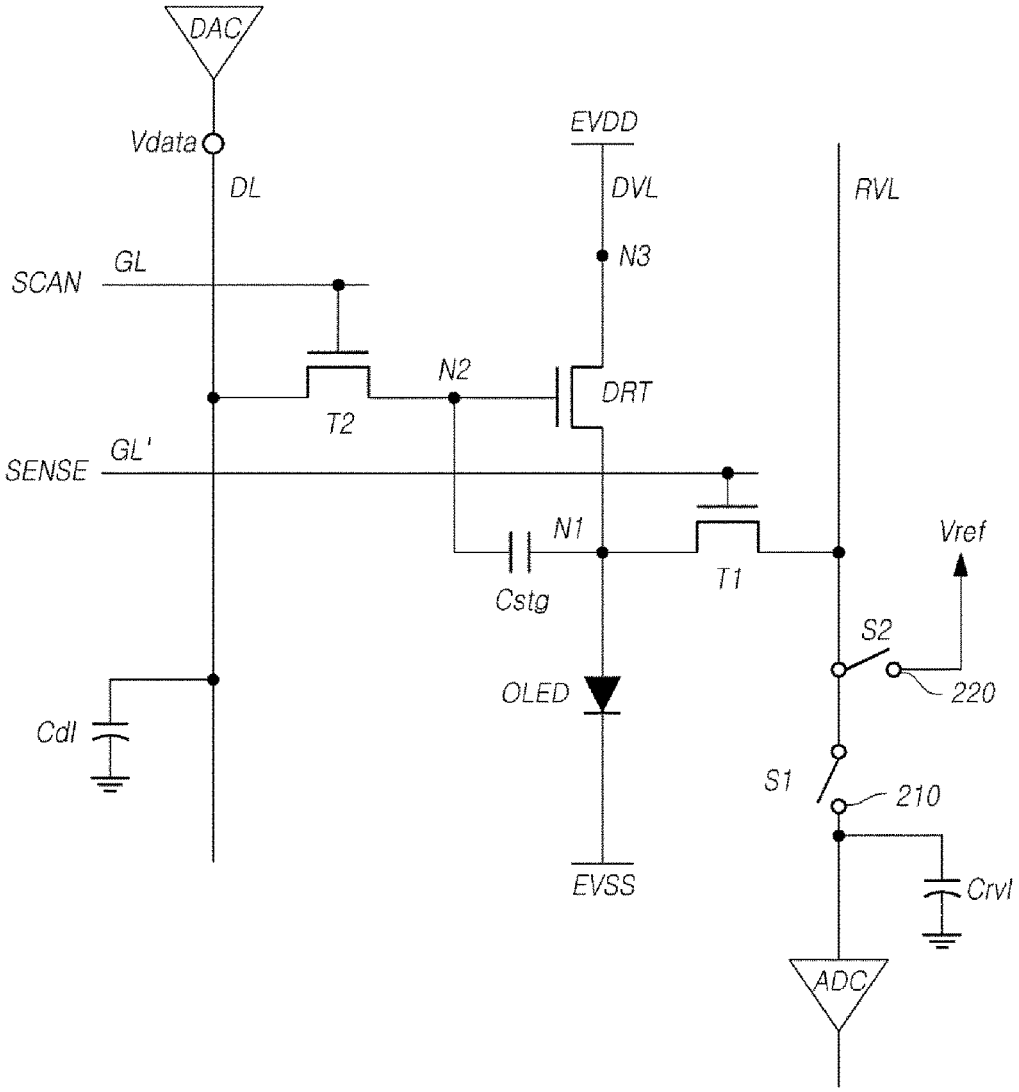
FIG. 2 is a circuit diagram illustrating an exemplary subpixel structure of the OLED display device according to the present embodiments.

FIG. 2 is a circuit diagram illustrating an exemplary subpixel structure of the OLED display device 110 according to the present embodiments.

Referring to FIG. 2, each of a plurality of subpixels arranged in a matrix in the OLED display device 100 according to the present embodiments includes an organic light-emitting diode (OLED), a driving transistor DRT, a first transistor T1, a second transistor T2, a storage capacitor Cstg, and the like.

Referring to FIG. 2, the driving transistor DRT is a transistor that drives the OLED by supplying a driving voltage to the OLED.

The driving transistor DRT includes a first node or N1 node electrically connected to a first electrode of the OLED, a second node or N2 node corresponding to a gate node, and a third node or N3 node electrically connected to a driving voltage line DVL.

Referring to FIG. 2, the first transistor T1 is controlled by a sensing signal SENSE, a type of scanning signal applied to the gate node through a corresponding gate line GL', and is electrically connected between the N1 node of the driving transistor DRT and a reference voltage line RVL.

The first transistor T1 is turned on by the sensing signal SENSE applied to the gate node, and applies a reference voltage Vref supplied through the reference voltage line RVL to the N1 node of the driving transistor DRT.

Referring to FIG. 2, the second transistor T2 is controlled by a scanning signal SCAN applied to the gate node through a corresponding gate line GL, and is electrically connected between the N2 node of the driving transistor DRT and a data line DL.

When a DAC in a source driver IC of the data driver 120 converts digital data into a data voltage Vdata and outputs the converted data voltage Vdata to the data line DL, the output data voltage Vdata is applied to a drain node or a source node of the second transistor T2 through the data line DL.

At this time, when the second transistor T2 is turned on by a scanning signal or the like, the second transistor T2 applies the data voltage Vdata, supplied through the data line, to the N2 node corresponding to the gate node of the driving transistor DRT.

Referring to FIG. 2, the storage capacitor Cstg is electrically connected between the N1 node and the N2 node of the driving transistor DRT, and serves to maintain a constant level of voltage for a period of a single frame.

Referring to FIG. 2, the OLED display device 100 according to the present embodiments further includes an analog-to-digital converter (ADC) electrically connected to the reference voltage line RVL via a switch S1 to sense a voltage on the reference voltage line RVL.

For example, the ADC may be included in each of the plurality of source driver ICs of the data driver 120.

A description of switch components connected to the reference voltage line RVL will be described hereinafter.

The switch S1 connects the reference voltage line RVL to a node 210 connected to the ADC or disconnects the reference voltage line RVL therefrom, depending on the switching operation.

A switch S2 connects the reference voltage line RVL to a node 220, to which the reference voltage Vref is supplied, or disconnects the reference voltage line RVL therefrom, depending on the switching operation.

The driving transistor DRT in each of the subpixels has unique characteristics, such as a threshold voltage Vth and mobility.

The driving transistor DRT may suffer from degradations along with the lapse of driving time, whereby the characteristics thereof change.

The driving transistors DRT in the plurality of subpixels may experience different degrees of degradation, causing variations in the unique characteristics (e.g. the threshold voltage and mobility) of the driving transistors DRT in the subpixels.

Variations in the unique characteristics may produce variations in the luminance of the subpixels, lowering the uniformity of the luminance of the OLED display panel 110, thereby degrading image quality.

In order to compensate for variations in the unique characteristics of the subpixels, the OLED display device 100 according to the present embodiments includes the subpixel structure illustrated in FIG. 2, the ADC, and the switch components S1 and S2.

Hereinafter, the operation of sensing the unique characteristics of the driving transistor DRT in order to compensate for variations in the unique characteristics of the driving transistors DRT of the subpixels will be described in brief. Specifically, the operation of sensing the threshold voltages of the driving transistors DRT will be described in brief.

First, a reference voltage Vref and a data voltage Vdata are applied to the N1 node and the N2 node of the driving transistor DRT.

For the application of the voltages, the first transistor T1 is turned on by the scanning signal SCAN applied to the gate node thereof, and the second transistor T2 is turned on by the first sensing signal SENSE applied to the gate node thereof. The switch S2 is in the on-state in which the switch S2 connects the reference voltage line RVL to the reference voltage supply node 220.

Thus, the data voltage Vdata output to the data line DL from the data driver 120 is applied to the N2 node of the driving transistor DRT through the second transistor T2. The reference voltage Vref supplied to a reference voltage supply nod Nref is applied to the N1 node of the driving transistor DRT through the reference voltage line RVL and the first transistor T1.

Afterwards, the switch S2 is turned off, i.e., the reference voltage RVL is disconnected from the reference voltage node 220, thereby floating the N1 node of the driving transistor DRT.

Consequently, the voltage of the N1 node of the driving transistor DRT is boosted from the reference voltage RVL. In this state, the data voltage Vdata is still being applied to the N2 node of the driving transistor DRT.

The boosting voltage of the N1 node of the driving transistor DRT is saturated at a predetermined level.

The saturated voltage of the N1 node of the driving transistor DRT differs from the data voltage Vdata by a predetermined voltage value.

The saturated voltage of the N1 node of the driving transistor DRT is a voltage (Vdata-Vth) obtained by subtracting the threshold voltage Vth of the driving transistor DRT from the data voltage Vdata.

Thereafter, the switch S1 is turned on, switching the node 210 connected to the ADC to be connected to the reference voltage line RVL.

Consequently, the ADC senses the voltage of the N1 node of the driving transistor DRT through the reference voltage line RVL, generates sensed data by converting the sensed voltage to a digital value, and transmits the sensed data to the timing controller 140.

Based on the sensed data, the timing controller 140 can obtain the threshold voltage Vth of the driving transistor DRT in each of the subpixels and can determine variations in the threshold voltage of the driving transistors DRT.

In order to compensate for the determined threshold voltage variations, the timing controller 140 calculates a data compensation amount for each of the subpixels, changes data regarding each of the subpixels based on the calculated data compensation amount, and transmits the changed data to the data driver 120.

The data driver 120 converts the received data to the data voltage, and outputs the data voltage Vdata to the data line, whereby subpixel compensation can be performed.

As described above, it is possible to compensate for variations in the unique characteristics of the driving transistors DRT by sensing the driving transistors DRT, thereby removing or reducing variations in the luminance of the driving transistors DRT, i.e. non-uniform screen characteristics, due to variations in the unique characteristics of the driving transistors DRT.

As described above, it is possible to precisely sense the unique characteristics, such as the threshold voltage, of the driving transistor DRT using the 3T1C subpixel structure, the sensing component ADC, and switching components S1 and S2, as illustrated in FIG. 2. It is possible to compensate for variations in the unique characteristics of the driving transistors DRT based on the sensed data.

As described above, the compensation for variations in the unique characteristics of the driving transistors DRT is performed by changing the digital data about the corresponding subpixels. Consequently, through the compensation, the data voltage Vdata to be applied to the OLED display panel 110 is changed.

In the meantime, each of the plurality of source driver ICs of the data driver 120 converts the digital data received from the timing controller 140 into a data voltage. The range in which each of the source driver ICs can handle the data voltage, i.e., a data voltage available range, may be limited.

The data voltage available range may basically include a range in which an image-representing data voltage Vimage can be adjusted (hereinafter referred to as a "gradation range").

In addition, since the OLED display device 100 provides a compensation function for the unique characteristics (the threshold voltage and mobility) of the driving transistor DRT, the data voltage available range may further include a range in which the unique characteristics (the threshold voltage and mobility) of the driving transistor DRT are compensated (hereinafter referred to as a "compensation area").

The compensation for the unique characteristics of the driving transistor DRT may include mobility compensation for the driving transistor DRT, threshold voltage variation compensation for the driving transistor DRT, and threshold voltage shift compensation for the driving transistor DRT.

The mobility compensation for the driving transistor DRT adjusts the mobility of the driving transistor DRT to a desirable level. The threshold voltage variation compensation for the driving transistors DRT removes or reduces variations in the threshold voltage of the driving transistors DRT.

The threshold voltage of each of the driving transistors DRT on the OLED display panel 110 has a specific distribution. The threshold voltages of the entirety of the driving transistors DRT increase with increases in the driving time of the driving transistors DRT, thereby shifting the overall threshold voltage distribution.

Such a shift in the threshold voltage (shift in the threshold voltage distribution when viewed in terms of the entirety of the subpixels) may cause compensation for the threshold voltage to be impossible, thereby degrading image quality.

Here, the threshold voltage shift compensation serves to shift the threshold voltages of the entire driving transistors DRT to a compensation-allowed range, i.e. a range in which the threshold voltages can be compensated. According to the threshold voltage shift compensation, the overall distribution of the threshold voltages of the driving transistors DRT is shifted to the compensation-allowed range.

Consequently, it is possible to perform compensation in the case in which the threshold voltages of the entire driving transistors DRT are shifted due to the degradation of the entire driving transistors DRT, thereby reducing the non-uniform luminance of the overall surface of the OLED display panel 110.

The above-described data voltage available range will be described again with reference to FIG. 3 and FIG. 4.

Figure 3:
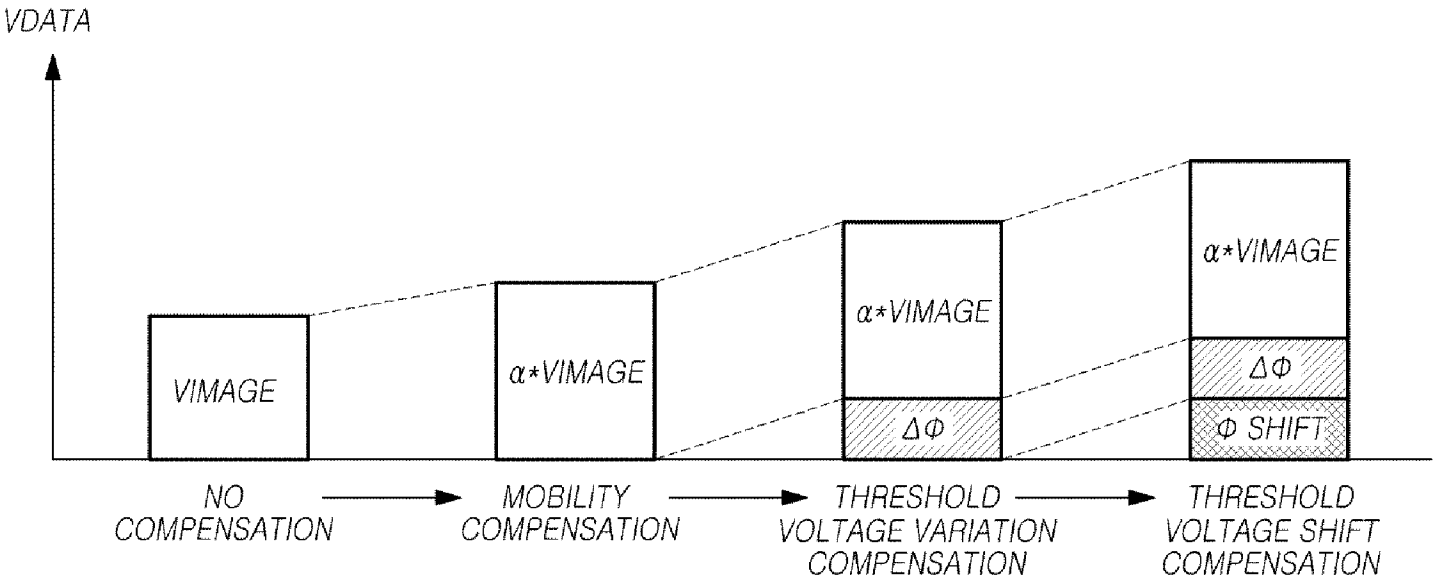
FIG. 3 illustrates the relationship between a data voltage available range and characteristics compensation functions regarding the driving transistor in the OLED display device according to the present embodiments.
Figure 4:
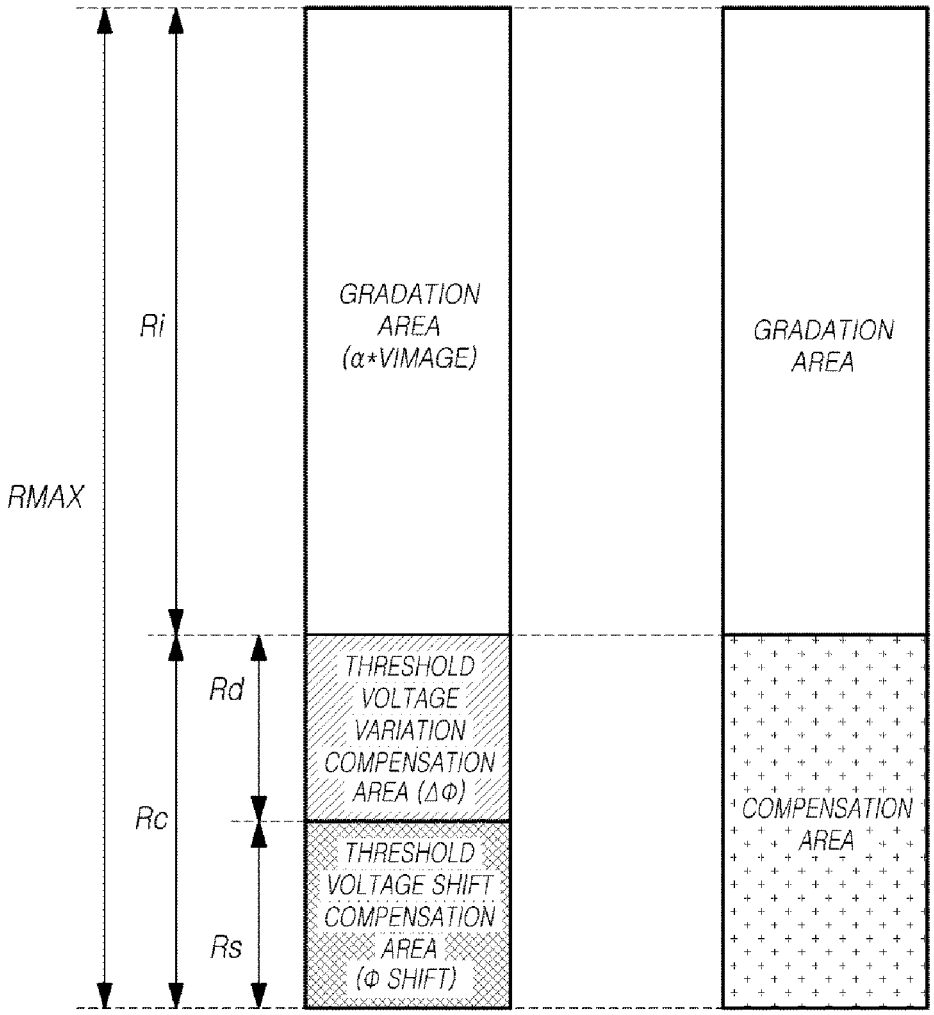
FIG. 4 illustrates a gradation area and a compensation area within the data voltage available range in the OLED display device according to the present embodiments.

FIG. 3 illustrates the relationship between a data voltage available range and characteristics compensation functions regarding the driving transistor DRT in the OLED display device 100 according to the present embodiments. FIG. 4 illustrates a gradation area and a compensation area within the data voltage available range in the OLED display device 100 according to the present embodiments.

Referring to FIG. 3 and FIG. 4, assuming that the OLED display device 100 has no compensation function, the data voltage available range only includes a gradation area in which an image-representing data voltage Vimage can be adjusted.

Referring to FIG. 3 and FIG. 4, when the OLED display device 100 according to the present embodiments has a further mobility compensation function, the data voltage available range includes the "gradation area" in which an image-representing data voltage $\alpha$*Vimage multiplied by a voltage $\alpha$ for compensation of the mobility of the driving transistor DRT can be adjusted.

Referring to FIG. 3 and FIG. 4, the OLED display device 100 according to the present embodiments not only has the mobility compensation function, but also the threshold voltage compensation function. In this case, the data voltage available range not only includes the gradation area in which the image-representing data voltage $\alpha$*Vimage multiplied by the voltage $\alpha$ for compensation for the mobility of the driving transistor DRT can be adjusted, but also a "threshold voltage variation compensation area" in which a voltage $\Delta\varphi$ for compensation (also referred to as $\varphi$ compensation) for variations in the threshold voltage of the driving transistor DRT can be adjusted.

Referring to FIG. 3 and FIG. 4, the OLED display device 100 according to the present embodiments not only has the mobility compensation function and the threshold voltage variation compensation function, but also a threshold voltage shift compensation function. In this case, the data voltage available range not only includes the gradation area in which the image-representing data voltage $\alpha$*Vimage multiplied by the voltage $\alpha$ for compensation for the mobility of the driving transistor DRT can be adjusted and the threshold voltage variation compensation area in which the voltage A) for compensation ($\varphi$ compensation) for variations in the threshold voltage of the driving transistor DRT can be adjusted, but also a "threshold voltage shift compensation area" in which a voltage for compensation for the shift ($\varphi$ shift) of the threshold voltage of the driving transistor DRT can be adjusted.

Referring to FIG. 3 and FIG. 4, the size of the gradation area is Ri, the size of the threshold voltage variation compensation area is Rd, and the size of the threshold voltage shift compensation area is Rs.

Referring to FIG. 4, the threshold voltage variation compensation area and the threshold voltage shift compensation area are collectively referred to as a "compensation area." The size of the compensation area is Rc (=Rd+Rs).

Figure 5:
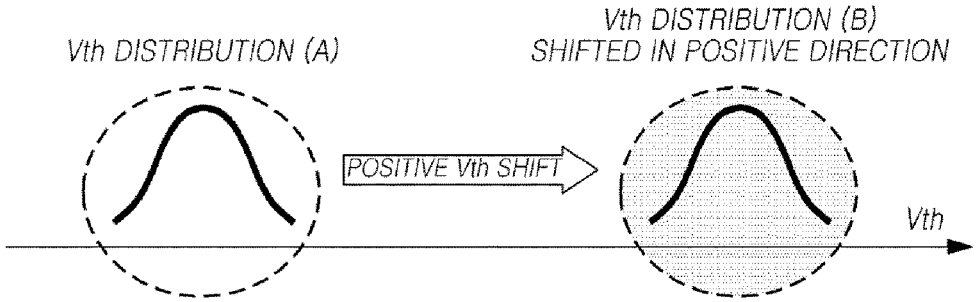
FIG. 5 illustrates a positive threshold voltage shift due to an increase in the driving time of the driving transistor in the OLED display device according to the present embodiments.
Figure 6:
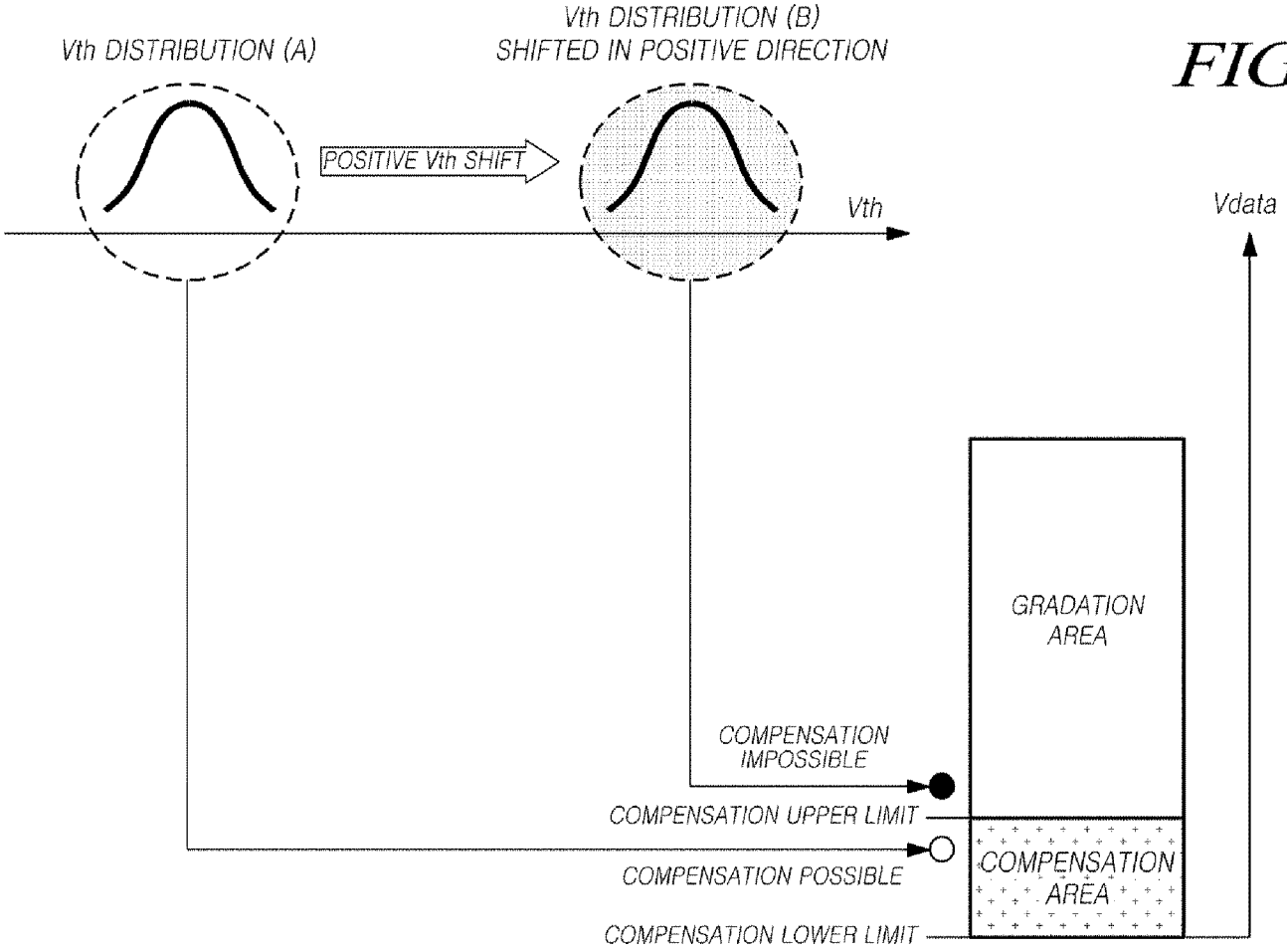
FIG. 6 illustrates compensation failure due to a threshold voltage shift in the OLED display device according to the present embodiments.
Figure 7:
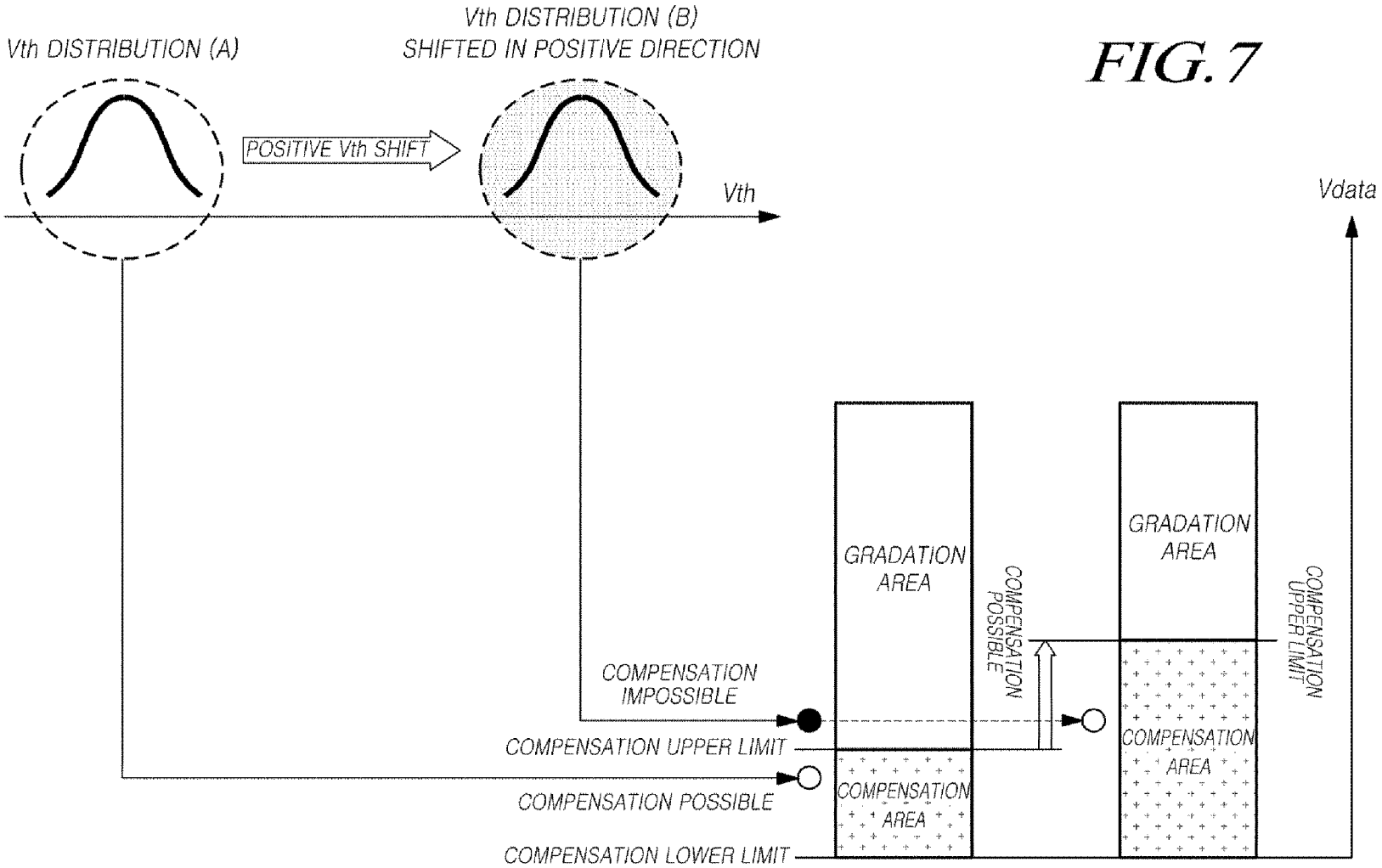
FIG. 7 illustrates a reduced gradation area due to a positive threshold voltage shift in the OLED display device 100 according to the present embodiments.

FIG. 5 illustrates a positive threshold voltage Vth shift due to an increase in the driving time of the driving transistor DRT in the OLED display device 100 according to the present embodiments, FIG. 6 illustrates compensation failure due to a threshold voltage shift in the OLED display device 100 according to the present embodiments, and FIG. 7 illustrates a reduced gradation area due to a positive threshold voltage shift in the OLED display device 100 according to the present embodiments.

Referring to FIG. 5, every driving transistor DRT on the OLED display panel 110 has unique threshold voltages Vth. The threshold voltage Vth of every driving transistor DRT has a specific distribution (hereinafter referred to as a "threshold voltage Vth distribution").

Referring to FIG. 5, the threshold voltage Vth of the driving transistor DRT shifts in the positive direction with an increase in the driving time. In other words, the threshold voltage Vth of the driving transistor DRT increases with an increase in the driving time. So, the overall threshold voltage distribution shifts in the positive direction (distribution A->distribution B).

As described above, the occurrence of a threshold voltage shift (distribution A->distribution B) proportionally increases a data compensation value with which compensation regarding the unique characteristics of the driving transistor DRT is performed.

When the occurrence of this threshold voltage shift (distribution A->distribution B) increases the data compensation value to exceed the compensation-allowed range (compensation area), compensation may become impossible or gradation may not be properly performed.

Referring to FIG. 6, when the ratio between the compensation area and the gradation area is fixed, a threshold voltage distribution shift (distribution A->distribution B) occurs. In this case, when a compensation value necessary for compensation regarding the unique characteristics of the driving transistor DRT (a voltage corresponding to a data compensation value) exceeds the limit of the compensation area (the upper compensation limit or the lower compensation limit) corresponding to the compensation-allowed range, compensation is impossible.

Consequently, variations in the luminance may not be compensated for, and luminance across the display panel may be non-uniform, thereby significantly lowering image quality.

Referring to FIG. 7, when the ratio between the compensation area and the gradation area is not fixed, a threshold voltage distribution shift (distribution A->distribution B) may occur. In this case, a compensation value necessary for compensation regarding the unique characteristics of the driving transistor DRT (a voltage corresponding to a data compensation value) may exceed the limit of the compensation area (the upper compensation limit of the lower compensation limit), a voltage range corresponding to the gradation area is used.

In this case, although compensation is possible, the gradation area for actually representing an image is reduced. Unfortunately, this may significantly degrade image quality.

In order to overcome the problems detailed above, such as disabled compensation or degrading image quality, due to the threshold voltage distribution shift (distribution A->distribution B), the OLED display device 100 according to the present embodiments can vary the data voltage available range by varying the reference voltage RVL, whereby the compensation area in the varied data voltage available range can be expanded.

Hereinafter, this will be described in greater detail with reference to FIG. 8 to FIG. 12.

Figure 8:
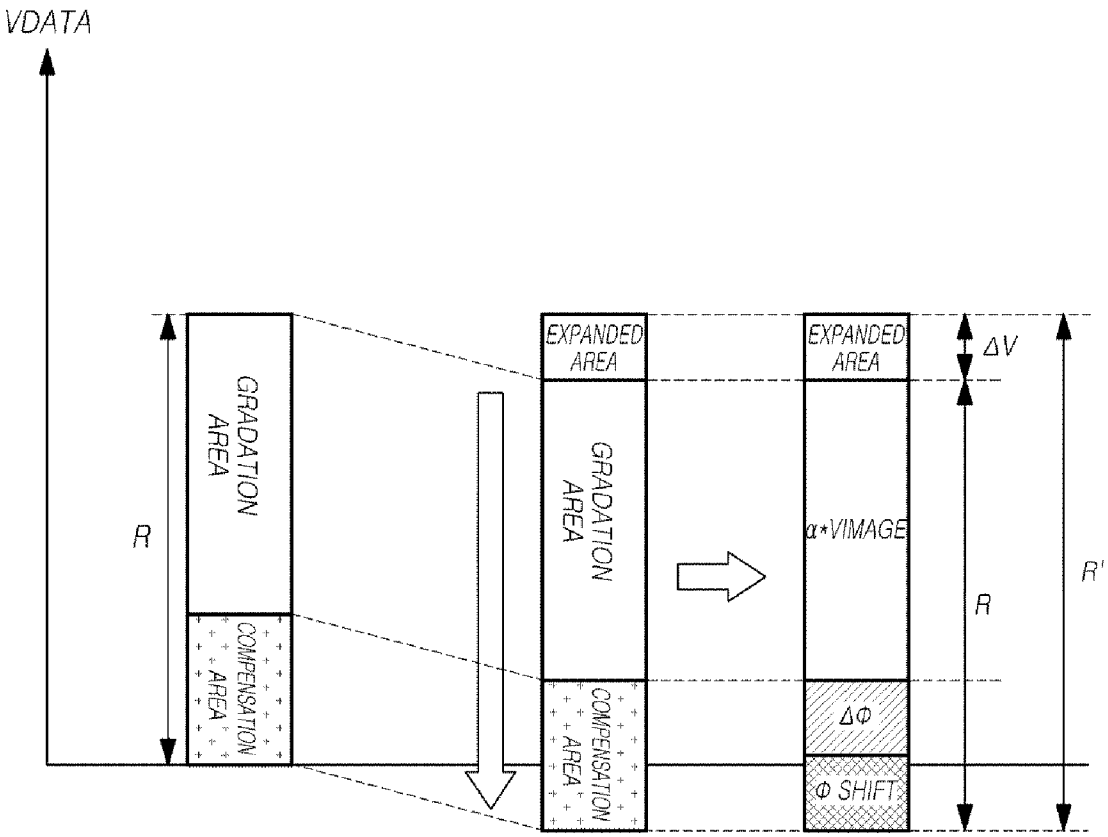
FIG. 8 illustrates a data voltage available range variation scheme intended to overcome problems regarding a positive threshold voltage shift in the OLED display device according to the present embodiments.

FIG. 8 illustrates a data voltage available range variation scheme intended to overcome the problems regarding the positive threshold voltage shift in the OLED display device 100 according to the present embodiments.

Referring to FIG. 8, in order to overcome the problems of the impossibility of compensation or the degrading image quality due to the threshold voltage distribution shift (distribution A ->distribution B), the data voltage available range regarding the data voltage Vdata applied to the N2 node of the driving transistor DRT is variable.

Referring to FIG. 8, the variable data voltage available range indicates that the size of the data voltage available range that the source driver IC can handle is changed from R to R'.

Since the data voltage available range is variable, the size of the compensation area in the data voltage available range can be varied, preventing the problems due to the positive threshold voltage shift without having an effect on the gradation.

Referring to FIG. 8, the variable data voltage available range that the source driver IC can handle indicates an expansion in the data voltage available range.

That is, before the data voltage available range is varied, the size of the data voltage available range is R. After the data voltage available range is varied, the size of the data voltage available range is R', increased by $\Delta V$.

Referring to FIG. 8, the expanded area of the data voltage available range (size: $\Delta V$) can be used for expanding an area for at least one of the mobility compensation, the threshold voltage variation compensation, and the threshold voltage shift compensation for the driving transistor DRT regarding the gradation area.

In the meantime, the variation of the data voltage available range may be caused by the variation of the reference voltage RVL. For example, when the reference voltage RVL is lowered, the data voltage available range may expand.

Figure 9:
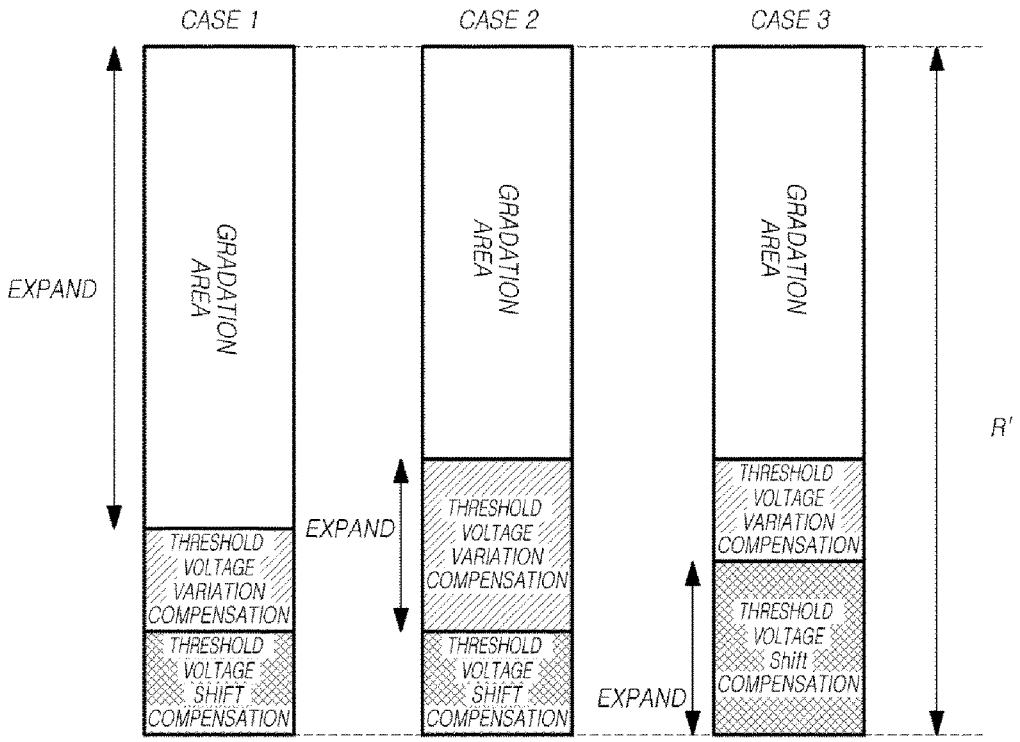
FIG. 9 illustrates an exemplary application of an expanded area of a data voltage available range according to a data voltage available range variation scheme in the OLED display device according to the present embodiments.

FIG. 9 illustrates an exemplary application of an expanded area of a data voltage available range according to a data voltage available range variation scheme in the OLED display device 100 according to the present embodiments.

Referring to FIG. 9, in the OLED display device 100 according to the present embodiments, the newly expanded area (expanded area) of the data voltage available range according to the data voltage available range variation scheme can be set for at least one selected among data compensation for the mobility compensation of the driving transistor DRT in each of the subpixels, data compensation for the threshold voltage variation compensation of the driving transistors DRT in the subpixels, and data compensation for the threshold voltage shift compensation of the driving transistor DRT in each of the subpixels.

Referring to FIG. 9, in Case 1, the expanded area of the data voltage available range according to the data voltage available range variation scheme can be set for data compensation for the mobility compensation of the driving transistor DRT in each of the subpixels. Consequently, the gradation area is expanded.

Referring to FIG. 9, in Case 2, the expanded area of the data voltage available range according to the data voltage available range variation scheme can be set for data compensation for the threshold voltage variation compensation of the driving transistors DRT in each of the subpixels. Consequently, the threshold voltage variation compensation area is expanded.

Referring to FIG. 9, in Case 3, the expanded area of the data voltage available range according to the data voltage available range variation scheme can be set for data compensation for the threshold voltage shift compensation of the driving transistor DRT in each of the subpixels. Consequently, the threshold voltage shift compensation area is expanded.

In addition to Case 1, Case 2, and Case 3 illustrated in FIG. 9, the expanded area can be applied as a combination of two or more cases of the three cases.

For example, as a combination of Case 1 and Case 2, both the gradation area and the threshold voltage variation compensation area can be expanded. As a combination of Case 2 and Case 3, both the threshold voltage variation compensation area and the threshold voltage shift compensation area can be expanded. As a combination of Case 1 and Case 3, both the gradation area (i.e., mobility compensation area) and the threshold voltage shift compensation area can be expanded. As a combination of Case 1, Case 2, and Case 3, all of the gradation area (i.e., mobility compensation area), the threshold voltage variation compensation area, and the threshold voltage shift compensation area can be expanded.

The expanded area of the data voltage available range can be used for expanding an area insufficient for compensation among the gradation area (mobility compensation area), the threshold voltage variation compensation area, and the threshold voltage shift compensation area.

For example, when the existing gradation area for the mobility compensation is insufficient, the gradation area can be expanded by an area the same as the expanded area of the data voltage available range. When the existing threshold voltage variation compensation area for the threshold voltage variation compensation is insufficient, the threshold voltage variation compensation area can be expanded by an area the same as the expanded area of the data voltage available range. When the existing threshold voltage shift compensation area for the threshold voltage shift compensation is insufficient, the threshold voltage shift compensation area can be expanded by an area the same as the expanded area of the data voltage available range.

As described above, any area insufficient for compensation among the mobility compensation, the threshold voltage variation compensation, and the threshold voltage shift compensation can be expanded based on the expanded area of the data voltage available range, whereby various types of compensation can be efficiently performed. Consequently, overall image quality can be significantly improved.

Figure 10:
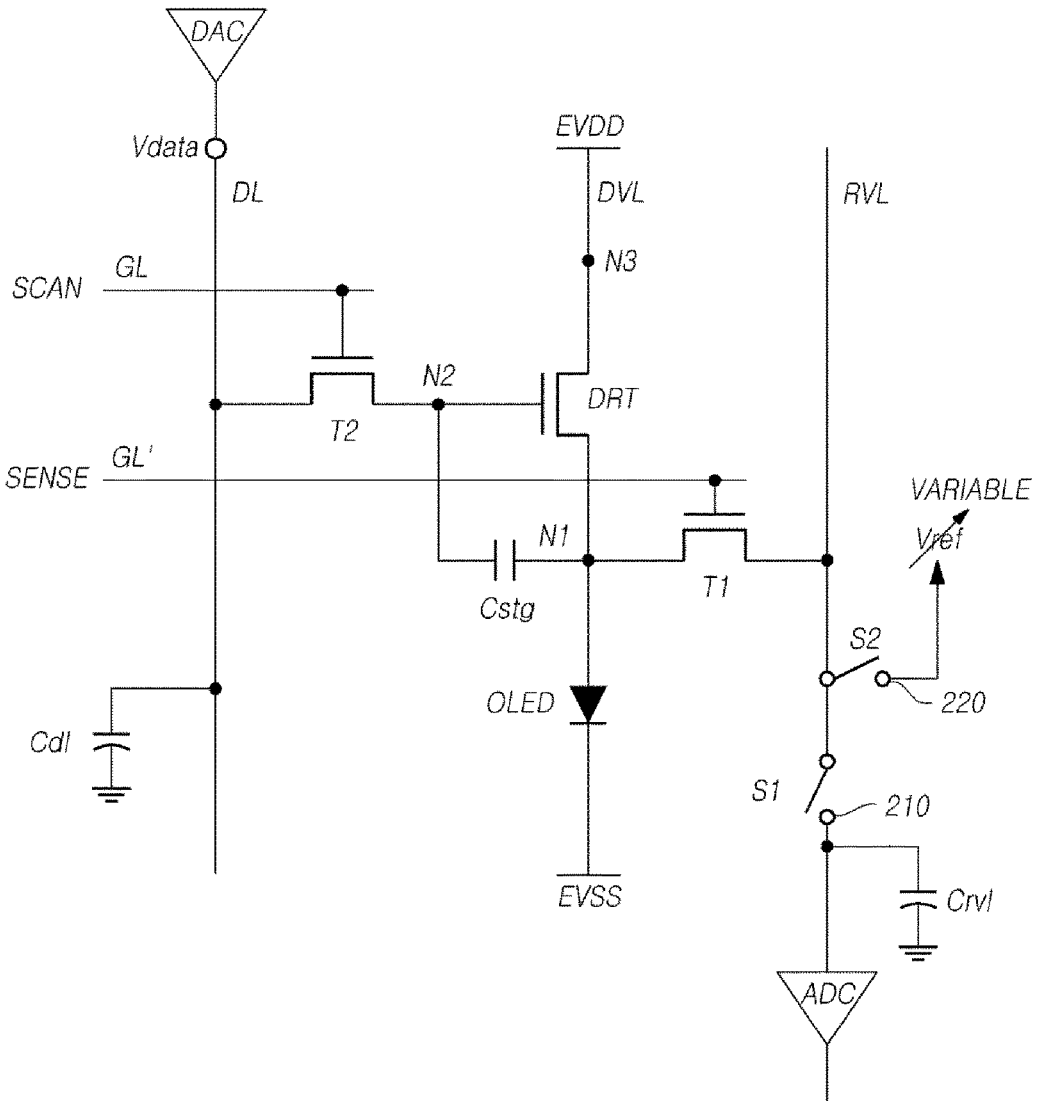
FIG. 10 and FIG. 11 illustrate a data voltage available range variation scheme based on reference voltage variation in the OLED display device according to the present embodiments.
Figure 11:
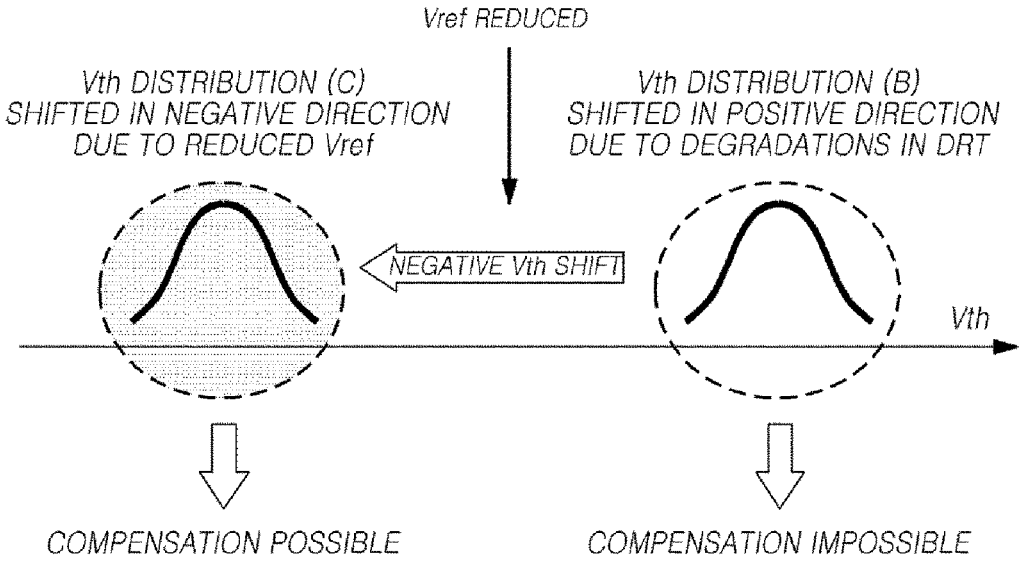

FIG. 10 and FIG. 11 illustrate a data voltage available range variation scheme based on reference voltage variation in the OLED display device 100 according to the present embodiments.

Referring to FIG. 10, the above-described data voltage available range variation scheme can be performed by varying a reference voltage RVL. That is, when the data voltage available range variation scheme is used, the reference voltage RVL supplied through the reference voltage line RVL can be varied.

In response to the reference voltage RVL corresponding to a common voltage in the OLED display panel 110 being varied, the data voltage available range can be varied.

More specifically, it is possible to expand the data voltage available range by lowering the reference voltage RVL corresponding to the common voltage in the OLED display panel 110.

In other words, when the reference voltage RVL is varied in the negative direction, the data voltage available range can be expanded, corresponding to the lowered reference voltage.

As described above, it is possible to expand the voltage available range by lowering the reference voltage RVL corresponding to the common voltage influential to the entire subpixels of the OLED display panel 110. Consequently, compensation that has been impossible is enabled or the problem of degrading image quality by reducing the gradation area can be overcome.

A reduction in the reference voltage RVL can be determined corresponding to a compensation value (voltage range) with which compensation has been impossible or a reduction in the gradation area for compensation.

In addition, as illustrated in FIG. 11, as the reference voltage RVL corresponding to the common voltage influential to the entire subpixels is varied in the negative direction, i.e., the reference voltage RVL is lowered, the threshold voltages of the entire driving transistors DRT are shifted in the negative direction.

Referring to FIG. 11, when the reduction of the reference voltage RVL is properly adjusted, the threshold voltage distribution can be shifted from distribution B in which compensation is impossible to distribution A in which compensation is possible.

Hereinafter, a method of driving the OLED display device 100 intended to overcome the problem of impossible compensation due to the positive threshold voltage shift or the problem of degrading image quality due to the reduced gradation area will be described in brief with reference to FIG. 12.

Figure 12:
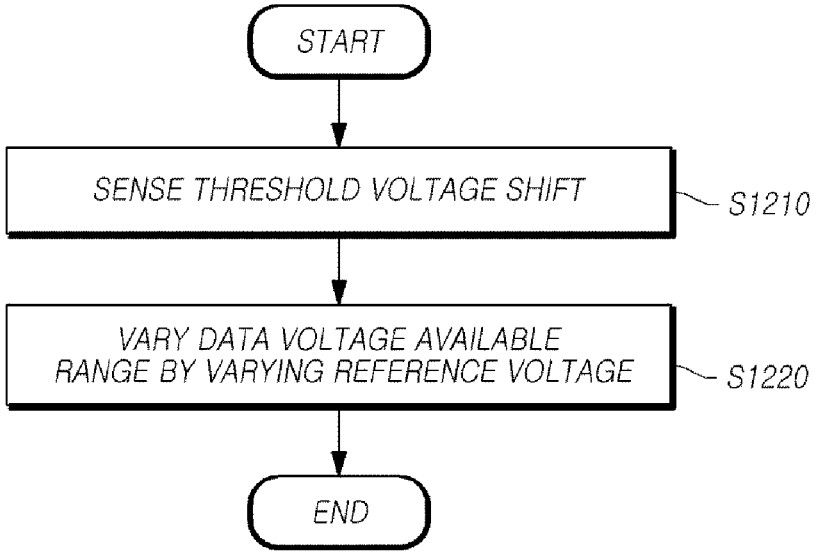
FIG. 12 is a flowchart illustrating a method of driving the OLED display device according to the present embodiments.

FIG. 12 is a flowchart illustrating the method of driving the OLED display device 100 according to the present embodiments.

Referring to FIG. 12, the OLED display device 100 according to the present embodiments includes the OLED display panel 110 having a matrix of a plurality of subpixels disposed thereon. Each of the subpixels includes: an OLED; a driving transistor DRT including an N1 node electrically connected to the first electrode of the OLED, an N2 node corresponding to a gate node, and an N3 node electrically connected to a driving voltage line DVL; a first transistor T1 electrically connected between the N1 node of the driving transistor DRT and a reference voltage line RVL; a second transistor electrically connected between the N2 node of the driving transistor DRT and a data line DL; and a storage capacitor Cstg electrically connected between the N1 node and the N2 node of the driving transistor DRT.

The method of driving the OLED display device 100 includes threshold voltage shift sensing operation S1210 of sensing a threshold voltage shift about the driving transistor DRT in each of the plurality of subpixels and data voltage available range variation operation S1220 of varying the data voltage available range of a data voltage applied to the N2 node of the driving transistor DRT in each of the plurality of subpixels, depending on the result of the threshold voltage shift sensing operation S1210.

The threshold voltage shift sensing operation S1210 can sense the threshold voltage shift by determining the threshold voltage of the driving transistor DRT in each of the subpixels through the sensing operation illustrated in FIG. 2, and statistically processing the determined threshold voltage.

The result of the threshold voltage shift sensing operation S1210 may exhibit that the threshold voltage of the driving transistor in each of the subpixels has shifted in the positive direction.

The above-described data voltage available range variation operation S1220 determines whether or not the degree of the threshold voltage shift sensed at the threshold voltage shift sensing operation S1210 allows compensation in the compensation area within the present data voltage available range. If it is determined that the compensation is impossible, the data voltage available range variation operation S1220 may vary the present data voltage available range such that the data voltage available range expands.

The method of driving the OLED display device 100 can prevent the compensation problems due to the positive threshold voltage shift by varying the compensation area within the data voltage available range.

When the threshold voltage shift about the driving transistor DRT in at least one of the plurality of subpixels is sensed as the result of the threshold voltage shift sensing operation S1210, the data voltage available range variation operation S1220 can expand the data voltage available range of the data voltage applied to the N2 node of the driving transistor DRT in each of the plurality of subpixels by varying the reference voltage in the negative direction.

As described above, at the data voltage available range variation operation S1220, it is possible to expand the data voltage available range by lowering the reference voltage RVL corresponding to the common voltage influential to the entire subpixels of the GELD display panel 110. Consequently, compensation that has been impossible is enabled or the problem of degrading image quality by reducing the gradation area can be overcome.

According to the present embodiments as set forth above, it is possible to provide the OLED display panel 110, the OLED display device 100, and the method of driving the same, which can improve image quality by more efficiently performing compensation for the unique characteristics of the driving transistor DRT (mobility compensation, threshold voltage variation compensation, and threshold voltage shift compensation).

In addition, according to the present embodiments as set forth above, it is possible to provide the OLED display panel 110, the OLED display device 100, and the method of driving the same, which can improve image quality by enabling compensation for the unique characteristics of the driving transistor DRT (mobility compensation, threshold voltage variation compensation, and threshold voltage shift compensation) without an influence on gradation under any circumstances.

Furthermore, according to the present embodiments as set forth above, it is possible to provide the OLED display panel 110, the OLED display device 100, and the method of driving the same, which can improve image quality by enabling compensation for the unique characteristics of the driving transistor DRT (mobility compensation, threshold voltage variation compensation, and threshold voltage shift compensation) regardless of the threshold voltage shift in the driving transistor DRT.

The foregoing descriptions and the accompanying drawings have been presented in order to explain the certain principles of the present invention. A person skilled in the art to which the invention relates can make many modifications and variations by combining, dividing, substituting for, or changing the elements without departing from the principle of the invention. The foregoing embodiments disclosed herein shall be interpreted as illustrative only but not as limitative of the principle and scope of the invention. It should be understood that the scope of the invention shall be defined by the appended Claims and all of their equivalents fall within the scope of the invention.

What is claimed is:

1. An organic light-emitting diode display device comprising:

an organic light-emitting diode display panel comprising a plurality of data lines, a plurality of gate lines, and a matrix of a plurality of subpixels disposed thereon;

a data driver driving the plurality of data lines;

a gate driver driving the plurality of gate lines; and a timing controller controlling the data driver and the gate driver, wherein each of the plurality of subpixels comprises:

an organic light-emitting diode;

a driving transistor having a first node electrically connected to a first electrode of the organic light-emitting diode, a second node corresponding to a gate electrode, and a third node electrically connected to a driving voltage line;

a first transistor electrically connected between the first node of the driving transistor and a reference voltage line;

a second transistor electrically connected between the second node of the driving transistor and a corresponding data line among the plurality of data lines;

a storage capacitor electrically connected between the first node and the second node of the driving transistor;

an analog-to-digital converter electrically connected to the reference voltage line;

a first switch electrically connected between the reference voltage line and the analog-to-digital converter node corresponding to each of the plurality of subpixels; and a second switch electrically connected between the reference voltage line and a reference voltage supplying node corresponding to each of the plurality of subpixels, wherein a data voltage available range for a data voltage applied to the second node of the driving transistor is variable, and wherein during a sensing operation, the first transistor and the second transistor are turned on and the second switch is turned on so that a data voltage output to the data line is applied to the second node and a reference voltage supplied to the reference voltage line is applied to the first node, thereafter, the second switch is turned off so that a voltage of the first node begins to rise to the reference voltage, and when the voltage of the first node rises to a saturated voltage, the first switch is turned on, and the analog-to-digital converter senses a voltage of the reference voltage line corresponding to the saturated voltage of the first node.

2. The organic light-emitting diode display device according to claim 1, wherein a threshold voltage of the driving transistor shifts only in a positive direction.

3. The organic light-emitting diode display device according to claim 1, wherein, when the reference voltage varies in a negative direction, the data voltage available range expands in response to the reference voltage being reduced.

4. The organic light-emitting diode display device according to claim 3, wherein a newly expanded area of the data voltage available range in response to the reference voltage being reduced is set for one or more selected from the group consisting of data compensation for mobility compensation of the driving transistor in each of the subpixels, data compensation for threshold voltage variation compensation of the driving transistor in each of the subpixels, and data compensation for threshold voltage shift compensation of the driving transistor in each of the subpixels.

5. An organic light-emitting diode display panel comprising:

a plurality of data lines;

a plurality of gate lines; and a matrix of a plurality of subpixels disposed thereon, wherein each of the plurality of subpixels comprises:

an organic light-emitting diode;

a driving transistor having a first node electrically connected to a first electrode of the organic light-emitting diode, a second node corresponding to a gate electrode, and a third node electrically connected to a driving voltage line;

a first transistor electrically connected between the first node of the driving transistor and a reference voltage line;

a second transistor electrically connected between the second node of the driving transistor and a corresponding data line among the plurality of data lines;

a storage capacitor electrically connected between the first node and the second node of the driving transistor;

an analog-to-digital converter electrically connected to the reference voltage line;

a first switch electrically connected between the reference voltage line and the analog-to-digital converter node corresponding to each of the plurality of subpixels; and a second switch electrically connected between the reference voltage line and a reference voltage supplying node corresponding to each of the plurality of subpixels, wherein a data voltage available range for a data voltage applied to the second node of the driving transistor is variable, and wherein during a sensing operation, the first transistor and the second transistor are turned on and the second switch is turned on so that a data voltage output to the data line is applied to the second node and a reference voltage supplied to the reference voltage line is applied to the first node, thereafter, the second switch is turned off so that a voltage of the first node begins to rise to the reference voltage, and when the voltage of the first node rises to a saturated voltage, the first switch is turned on, and the analog-to-digital converter senses a voltage of the reference voltage line corresponding to the saturated voltage of the first node.

6. A method of driving an organic light-emitting diode display device, wherein the organic light-emitting diode display device comprises a matrix of a plurality of subpixels disposed thereon, each of the subpixels comprising: an organic light-emitting diode; a driving transistor including a first node electrically connected to the first electrode of the organic light-emitting diode, a second node corresponding to a gate node, and a third node electrically connected to a driving voltage line; a first transistor electrically connected between the first node of the driving transistor and a reference voltage line; a second transistor electrically connected between the second node of the driving transistor and a data line; a storage capacitor electrically connected between the first node and the second node of the driving transistor; an analog-to-digital converter electrically connected to the reference voltage line; a first switch electrically connected between the reference voltage line and the analog-to-digital converter node corresponding to each of the plurality of subpixels; and a second switch electrically connected between the reference voltage line and a reference voltage supplying node corresponding to each of the plurality of subpixels, the method comprising:

sensing a threshold voltage shift about the driving transistor in each of the plurality of subpixels; and depending on a result of sensing the threshold voltage shift, varying a data voltage available range of a data voltage applied to the second node of the driving transistor in each of the plurality of subpixels, wherein during the sensing the threshold voltage shift, the first transistor and the second transistor are turned on and the second switch is turned on so that a data voltage output to the data line is applied to the second node and a reference voltage supplied to the reference voltage line is applied to the first node, thereafter, the second switch is turned off so that a voltage of the first node begins to rise to the reference voltage, and when the voltage of the first node rises to a saturated voltage, the first switch is turned on, and the analog-to-digital converter senses a voltage of the reference voltage line corresponding to the saturated voltage of the first node.

7. The method according to claim 6, wherein, when the threshold voltage shift for the driving transistor in at least one of the plurality of subpixels is sensed, the varying of the data voltage available range comprises varying a reference voltage in a negative direction, thereby expanding the data voltage available range of the data voltage applied to the second node of the driving transistor in each of the plurality of subpixels.

8. The method according to claim 7, wherein a newly expanded area of the data voltage available range is set for one or more selected from the group consisting of data compensation for mobility compensation of the driving transistor in each of the subpixels, data compensation for threshold voltage variation compensation of the driving transistor in each of the subpixels, and data compensation for threshold voltage shift compensation of the driving transistor in each of the subpixels.

9. The method according to claim 6, wherein the result of sensing the threshold voltage shift exhibits that a threshold voltage of the driving transistor in each of the plurality of subpixels is shifted in a positive direction.

* * * * *